US012359678B1

(12) United States Patent
Lin et al.

(10) Patent No.: US 12,359,678 B1
(45) Date of Patent: Jul. 15, 2025

(54) CEILING FAN

(71) Applicant: JIANGMEN KEYE ELECTRIC APPLIANCES MANUFACTURING CO., LTD, Jiangmen (CN)

(72) Inventors: Guanglian Lin, Jiangmen (CN); Weiquan Li, Jiangmen (CN)

(73) Assignee: JIANGMEN KEYE ELECTRIC APPLIANCES MANUFACTURING CO., LTD, Jiangmen (CN)

( * ) Notice: Subject to any disclaimer, the term of this patent is extended or adjusted under 35 U.S.C. 154(b) by 0 days.

(21) Appl. No.: 18/822,877

(22) Filed: Sep. 3, 2024

(51) Int. Cl.

| | |
|---|---|
| ***F04D 29/70*** | (2006.01) |
| ***F04D 19/00*** | (2006.01) |
| ***F04D 27/00*** | (2006.01) |
| ***F04D 29/32*** | (2006.01) |
| ***F04D 29/64*** | (2006.01) |

(52) U.S. Cl.
CPC ..... *F04D 29/646* (2013.01); *F04D 19/002* (2013.01); *F04D 27/004* (2013.01); *F04D 29/325* (2013.01); *F04D 29/703* (2013.01)

(58) Field of Classification Search
CPC .... F04D 29/646; F04D 19/002; F04D 27/004; F04D 29/625; F04D 29/703
See application file for complete search history.

(56) References Cited

U.S. PATENT DOCUMENTS 5,547,343 A * 8/1996 Jane ..... F04D 29/601 416/246
6,099,258 A * 8/2000 Litvin ..... F04D 29/703 415/214.1

FOREIGN PATENT DOCUMENTS

| | | | |
|---|---|---|---|
| CN | 201425033 | Y | 3/2010 |
| CN | 107524618 | A | 12/2017 |
| CN | 215409445 | U | 1/2022 |

* cited by examiner

*Primary Examiner* — Aaron R Eastman
(74) *Attorney, Agent, or Firm* — Schmeiser, Olsen & Watts LLP

(57) ABSTRACT

A ceiling fan is provided. The ceiling fan includes a mounting fixture configured to removably connect the ceiling fan to an installation location; a connecting rod, one end of which is connected to the mounting fixture; a motor assembly including a housing, a rotor and a stator located in the housing, and a motor shaft fixed to the stator, wherein a first end of the motor shaft is connected to the other end of the connecting rod, a second end of the motor shaft extends out of the housing, the motor shaft includes a hollow channel, and the rotor is sleeved on outside of the stator; a protective grill including an upper grill and a lower grill that are removably connected to each other, wherein the upper grill is connected to the housing; a fan blade assembly, accommodated in the accommodation space and connected to the rotor.

10 Claims, 7 Drawing Sheets

CEILING FAN

CROSS-REFERENCE TO RELATED APPLICATIONS

This application claims priority to Chinese Patent Application No. 202410687286.9, filed on May 29, 2024, the entire contents of which are hereby incorporated by reference.

FIELD OF TECHNOLOGY

The following relates to the technical field of household appliances, and in particular to a ceiling fan.

BACKGROUND

Ceiling fans are becoming more and more widely used due to their advantages such as not taking up floor and table space and generating greater airflow than table fans.

However, traditional ceiling fans are usually fans fixed on the ceiling. Since the ceiling fan is fixedly connected to the ceiling, the distance between the ceiling fan and the ground is fixed, so blowing range of the ceiling fan to the ground is also relatively fixed. It cannot be adjusted according to usage needs. In addition, traditional ceiling fans usually require a switch installed on a side of the wall to adjust air volume of the ceiling fan, which is inconvenient for users to operate.

To this end, it is necessary to improve and optimize the existing ceiling fans.

SUMMARY

According to an aspect of this disclosure, a ceiling fan is disclosed.

The ceiling fan includes:

a mounting fixture configured to removably connect the ceiling fan to an installation location; a connecting rod, one end of which is connected to the mounting fixture;

a motor assembly including a housing, a rotor and a stator located in the housing, and a motor shaft fixed to the stator, wherein a first end of the motor shaft is connected to the other end of the connecting rod, a second end of the motor shaft extends out of the housing, the motor shaft includes a hollow channel, and the rotor is sleeved on outside of the stator;

a protective grill including an upper grill and a lower grill that are removably connected to each other, forming an accommodation space therebetween, wherein the upper grill is connected to the housing;

a fan blade assembly, accommodated in the accommodation space and connected to the rotor; and a switch assembly configured to adjust a rotation speed of the rotor, wherein the switch assembly is connected to the motor shaft, the hollow channel is configured for wiring of connecting wires of the switch assembly, and the switch assembly is arranged at the center of the lower grill.

BRIEF DESCRIPTION

Some of the embodiments will be described in detail, with references to the following Figures, wherein like designations denote like members, wherein.

DETAILED DESCRIPTION

In the following, technical solutions of the present disclosure will be described clearly and completely in combination with drawings. Obviously, the embodiments described herein are only a few embodiments of the present disclosure, not all of the embodiments. Based on the embodiments of the present disclosure, all other embodiments obtained by a person skilled in the conventional art without inventive work will fall into the scope of the present disclosure.

Figure 1:
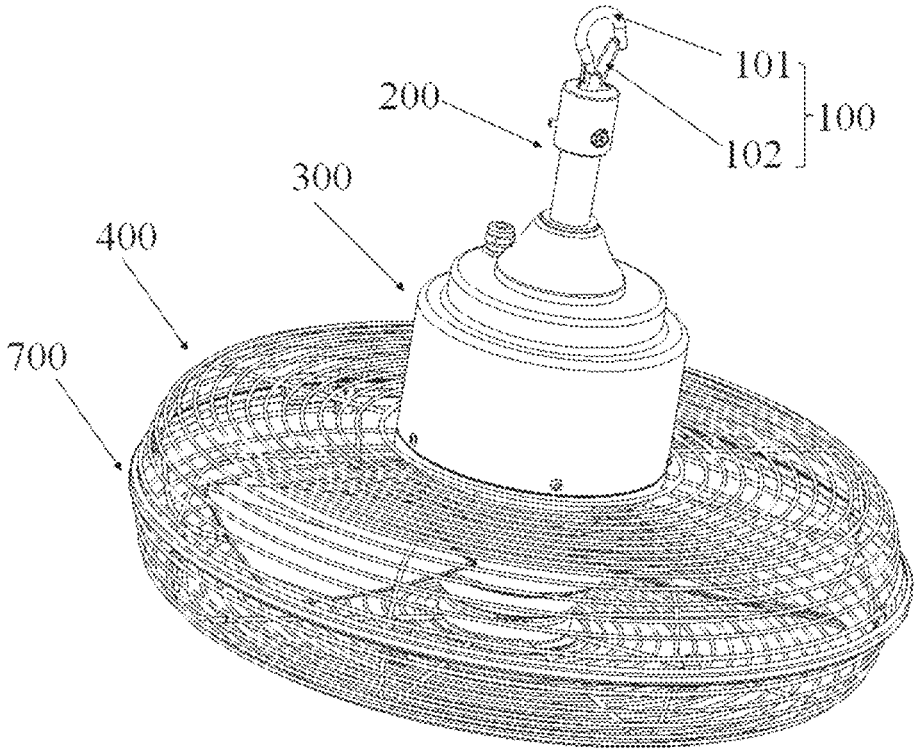
FIG. 1 is a perspective structural schematic diagram of a ceiling fan of the present disclosure.
Figure 2:
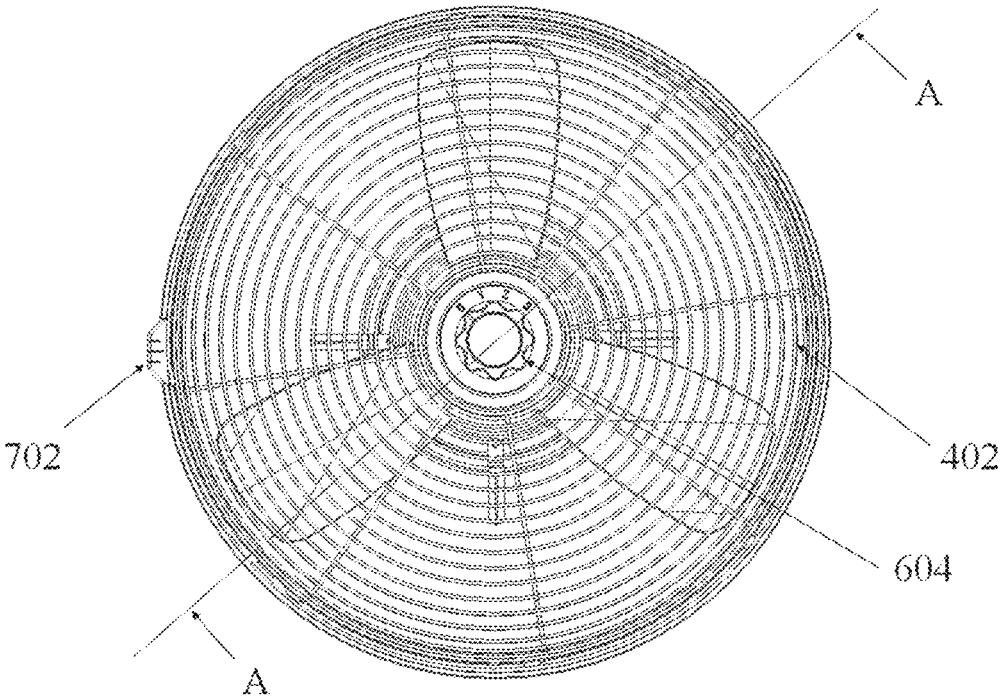
FIG. 2 is a bottom structural schematic diagram of the ceiling fan of the present disclosure in FIG. 1.
Figure 3:
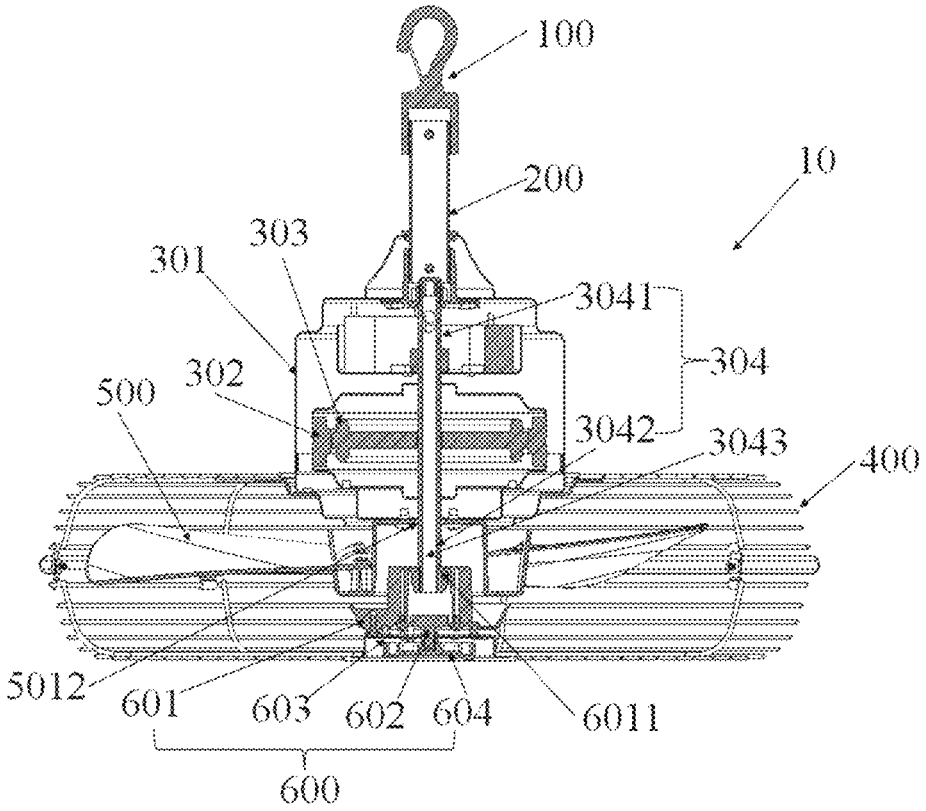
FIG. 3 is a cross-sectional schematic diagram of the ceiling fan of the present disclosure along a line A-A in FIG. 2.
Figure 4:
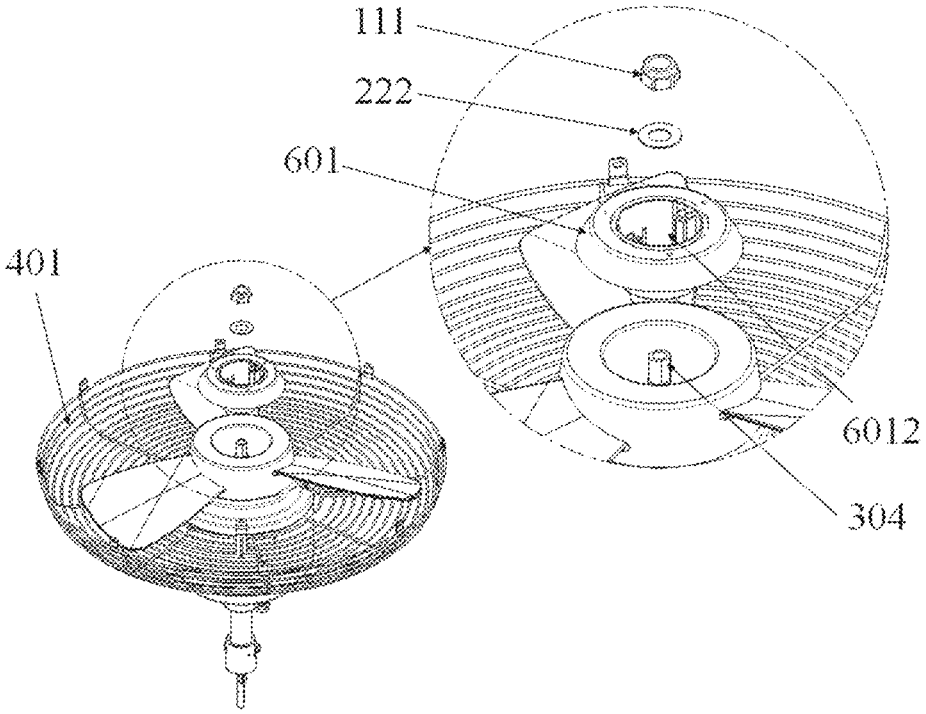
FIG. 4 is a partial structural schematic diagram of the ceiling fan of the present disclosure, showing installation of a switch base.
Figure 5:
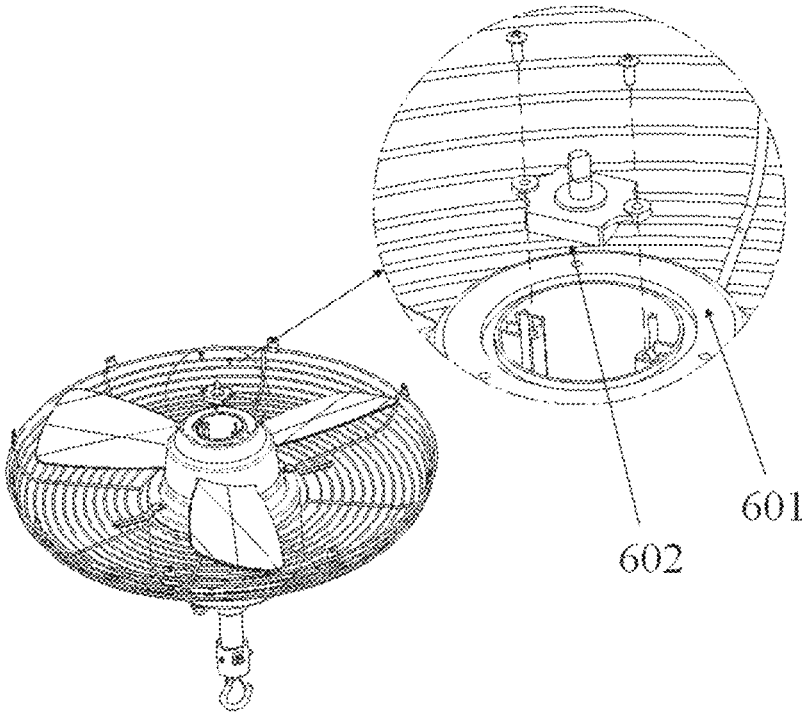
FIG. 5 is a partial structural schematic diagram of the ceiling fan of the present disclosure, showing installation of a switch.

As shown in FIGS. 1-3, the present disclosure discloses a ceiling fan 10, which includes a mounting fixture 100, a connecting rod 200, a motor assembly 300, a protective grill 400, a fan blade assembly 500 and a switch assembly 600. The mounting fixture 100 is configured to removably connect the ceiling fan 10 to an installation location, so that users can freely adjust the installation location of the ceiling fan 10 at any time according to needs to adjust a blowing range of the ceiling fan 10. One end of the connecting rod 200 is connected to the mounting fixture 100, and in this embodiment, the two are connected together by screws. The motor assembly 300 including a housing 301, a rotor 302 and a stator 303 located in the housing 301, and a motor shaft 304 fixed to the stator 303. A first end 3041 of the motor shaft 304 is connected to the other end of the connecting rod 200, and a second end 3042 of the motor shaft 304 extends out of the housing 301. The motor shaft 304 includes a hollow channel 3043, and the rotor 302 is sleeved on outside of the stator 303. The protective grill 400 includes an upper grill 401 and a lower grill 402 that are removably connected to each other, forming an accommodation space therebetween, wherein the upper grill 401 is connected to the housing 301. The fan blade assembly 500 is accommodated in the accommodation space and connected to the rotor 302, thereby a rotation of the rotor 302 may drive a rotation of the fan blade assembly 500. The switch assembly 600 is configured to adjust a rotation speed of the rotor 302, wherein the switch assembly 600 is connected to the motor shaft 304. Since the motor shaft 304 is fixedly connected to the stator 303, when the ceiling fan 10 rotates, the motor shaft 304, the stator 303 and the switch assembly 600 remain stationary. Wiring of connecting wires of the switch assembly 600 is arranged in the hollow channel 3043, which cleverly prevents the wiring of the connecting wires from being exposed to the outside. In addition, the motor shaft 304 is arranged as a hollow structure, which reduces manufacturing materials of the motor assembly 300, reduces the manufacturing cost, and simplifies structural complexity of the wiring of the connecting wires of the switch assembly 600. The switch assembly 600 is arranged at the center of the lower grill 402, which is convenient for the user to control the rotation speed of the ceiling fan 10.

As shown in FIGS. 3-5 and 8-9, the switch assembly 600 includes a switch seat 601, a mounting hole 6011 is provided at the center of a bottom of the switch seat 601, a thread is provided axially on an outer side of the second end 3042 of the motor shaft 304, the switch seat 601 is sleeved on the second end 3042 of the motor shaft 304 through the mounting hole 6011 and is connected to the motor shaft 304 by a nut 111 locked to the thread on the outer side of the second end 3042 of the motor shaft 304. In this embodiment, a flat medium 222 is further provided between the nut 111 and a bottom of the switch seat 601. Therefore, the switch seat 601 may be installed by cooperation between the nut 111 and the thread, so that assembly and disassembly of the switch seat 601 is simple and easy to operate. In this embodiment, the bottom of the switch seat 601 is a plane, a circular mounting hole 6011 is provided at the center of the plane, and the switch seat 601 is provided with a cylindrical mounting cavity 6012 connected to the circular mounting hole 6011. The switch assembly 600 further includes a switch 602, a switch plate 603 and a knob 604, wherein the switch 602 is connected to the mounting cavity 6012, and in this embodiment, the switch 602 is connected to the mounting cavity 6012 by screws. The switch plate 603 is mounted on the switch seat 601, and the knob 604 is disposed above the switch plate 603 and connected to the switch 602. The switch plate 603 is disposed between the switch 602 and the knob 604.

Figure 10:
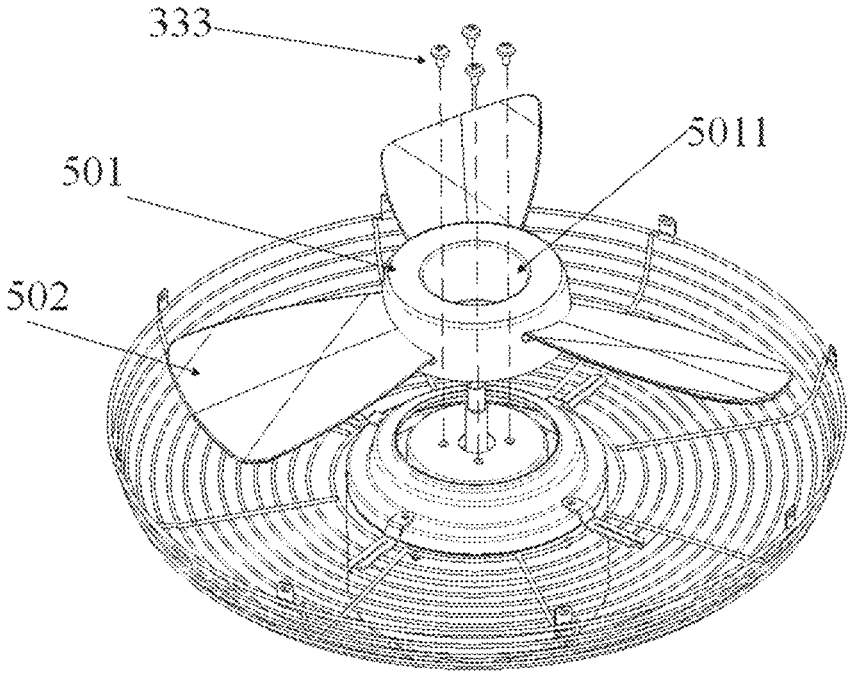
FIG. 10 is a partial structural schematic diagram of the ceiling fan of the present disclosure, showing installation of a fan blade assembly.

Further, as shown in FIGS. 3 and 10, the fan blade assembly 500 includes a fan blade seat 501 and fan blades 502, the number of the fan blades 502 is three or more. In this embodiment, the number of the fan blades 502 is three and the fan blades 502 are connected to the fan blade seat 501 by screws. The fan blade seat 501 is connected to the rotor 302 by screws 333. A cylindrical cavity 5011 is provided at the center of the fan blade seat 501, and a through hole 5012 is provided on a bottom wall of the cylindrical cavity 5011 for the motor shaft 304 to pass through. A portion of the switch seat 601 is located in the cylindrical cavity 5011, and the switch seat 601 and the cylindrical cavity 5011 do not contact each other. In this way, the structure of the ceiling fan 10 is made more compact.

Figure 6:
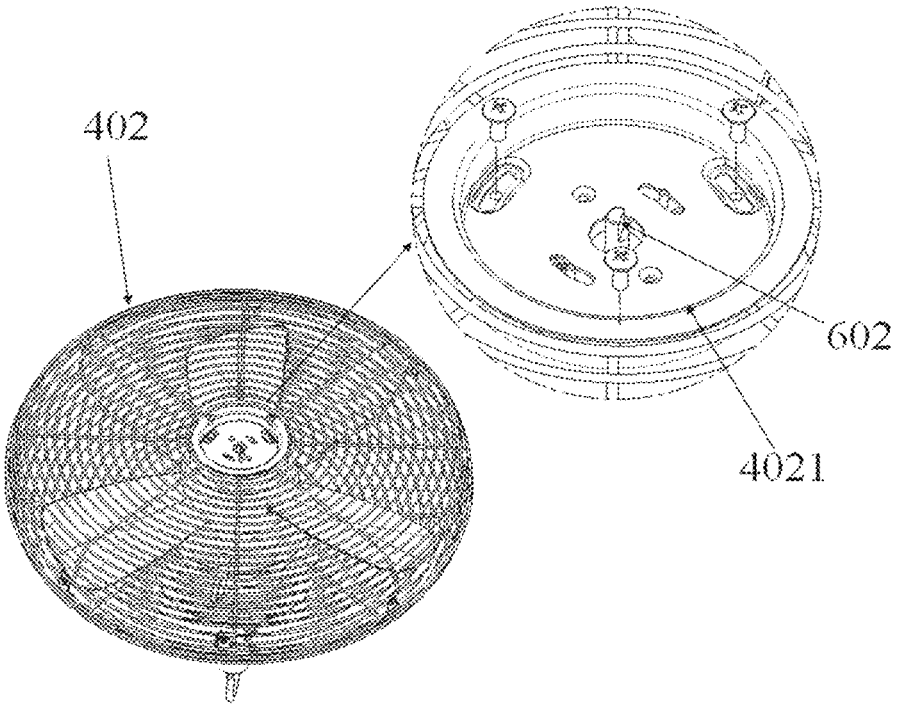
FIG. 6 is a partial structural schematic diagram of the ceiling fan of the present disclosure, showing installation of a lower grill.
Figure 8:
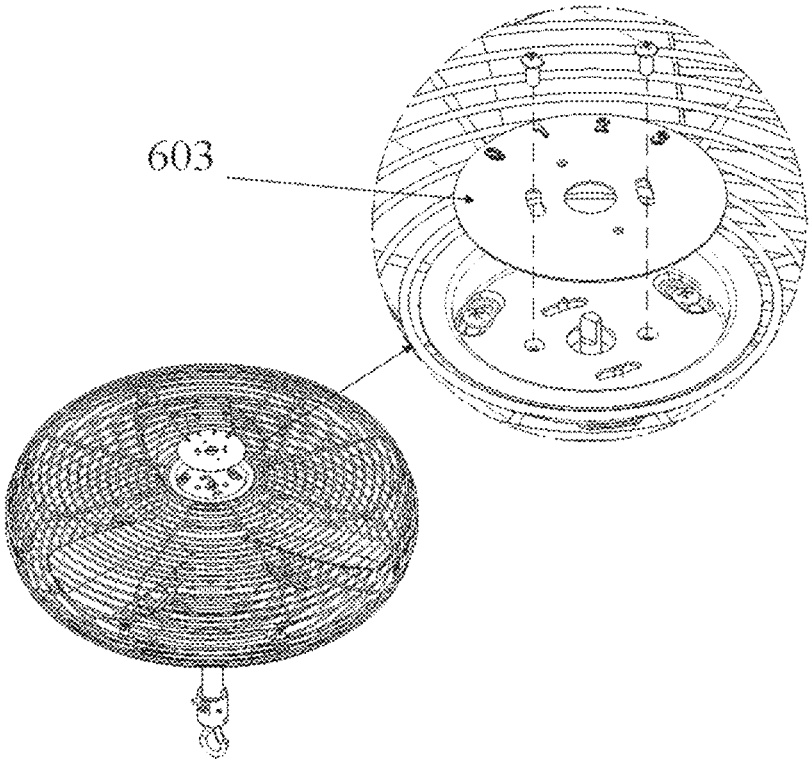
FIG. 8 is a partial structural schematic diagram of the ceiling fan of the present disclosure, showing installation of a switch plate.
Figure 9:
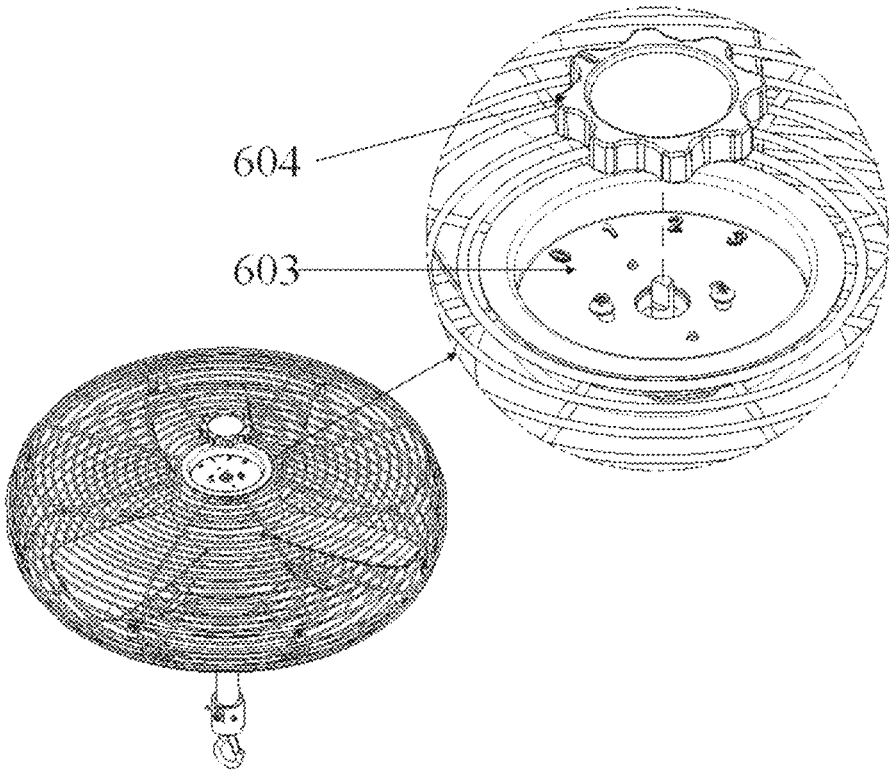
FIG. 9 is a partial structural schematic diagram of the ceiling fan of the present disclosure, showing installation of a knob.

As shown in FIGS. 6 and 8-9, a recessed portion 4021 is provided at the center of a lower end of the lower grill 402 and is recessed toward the switch seat 601, a bottom surface of the recessed portion 4021 is a plane. In this embodiment, the bottom surface is circular and a side wall of the recessed portion 4021 is an annular side wall. The lower end mentioned here refers to a direction away from the switch seat 601 in the vertical downward direction when the ceiling fan 10 is in use. The bottom surface is provided with three through holes along its circumferential edge for detachably connecting the lower grill 402 to the switch seat 601 by screws; a center of the bottom surface is provided with a through hole for passing the switch 602 therethrough. The switch plate 603 is mounted to the bottom surface of the recessed portion 4021, the knob 604 is arranged above the switch plate 603 and is locked to the switch 602. The knob 604 is substantially flush with an upper surface of the recessed portion 4021, that is, the knob 604 does not protrude from the lower end of the lower grill 402. Thus, visually, the knob 604 and the lower end of the lower grill 402 are located in the same plane, which looks with a simple design. The recessed portion 4021 may be integrally formed with other parts of the lower grill 402, or fixedly connected to other parts of the lower grill 402 by a method commonly known in the conventional art, such as welding.

Figure 7:
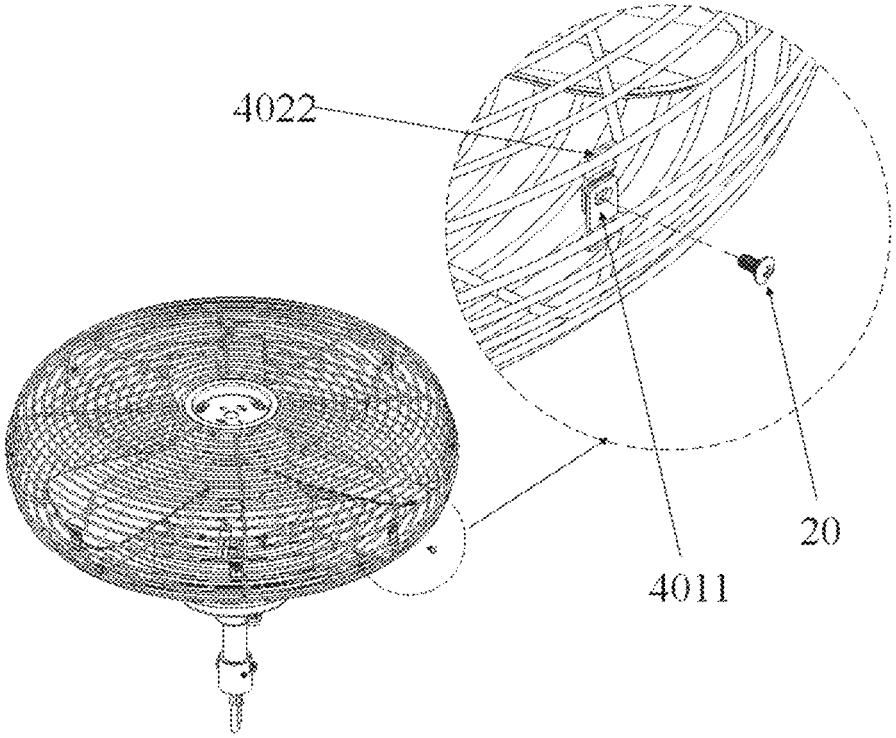
FIG. 7 is a partial structural schematic diagram of the ceiling fan of the present disclosure, showing installation between an upper grill and the lower grill.
Figure 11:
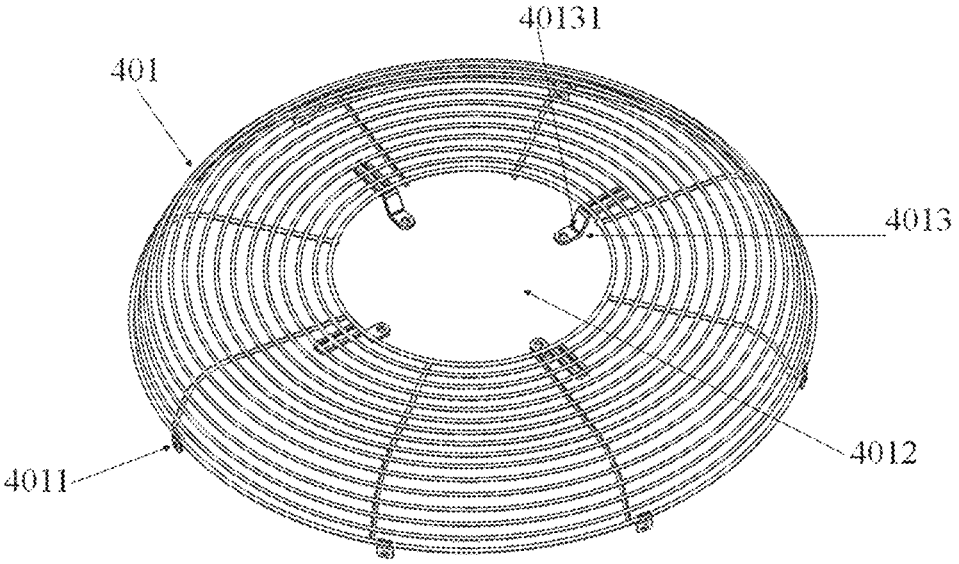
FIG. 11 is a structural schematic diagram of the upper grill of the ceiling fan of the present disclosure.

As shown in FIGS. 11 and 7, the upper grill 401 is evenly provided with two or more upper connecting pieces 4011 around a circumferential edge of the upper grill 401, and the lower grill 402 is evenly provided with more than two corresponding lower connecting pieces 4022 around a circumferential edge of the lower grill 402, each of the upper connecting pieces 4011 and each of the lower connecting pieces 4022 are both provided with a threaded hole, the upper connecting piece 4011 and the corresponding lower connecting piece 4022 are connected together by a screw 20, and when the ceiling fan 10 is in use state, an axial direction of the screw 20 is parallel to the horizontal plane. The upper grill 401 and the lower grill 402 of the ceiling fan 10 of the present disclosure are fixed together by horizontal screws 20. Even if they become loose, they will not fall off due to gravity, so that the upper grill 401 and the lower grill 402 are kept together, improving the safety when installing and removing the lower grill 402.

The upper grill 401 is further provided with a motor assembly mounting hole 4012 and two or more fixings 4013, the motor assembly mounting hole 4012 is arranged at the center of the upper grill 401, the two or more fixings 4013 are evenly distributed along a circumference of the motor assembly mounting hole 4012 and extend into the motor assembly mounting hole 4012; a portion of each of the two or more fixings 4013 extending into the motor assembly mounting hole 4012 includes a stepped portion 40131 which abuts against the housing 301.

Figure 12:
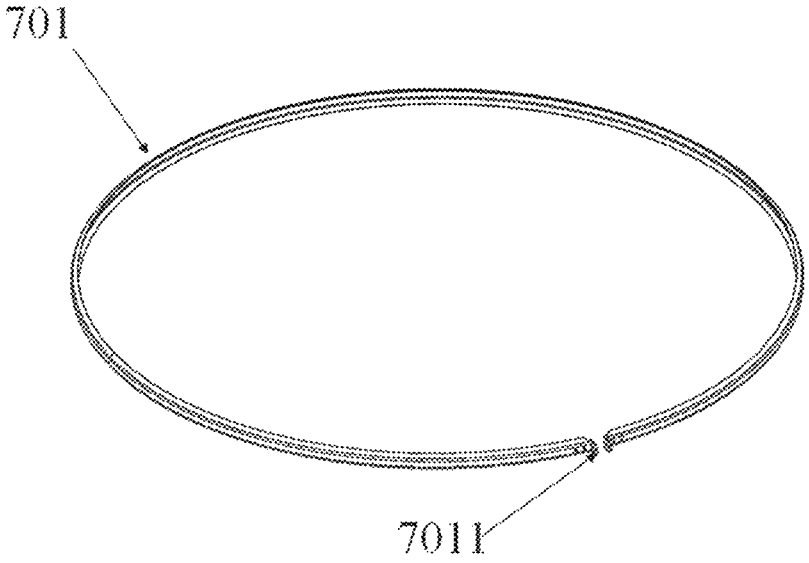
FIG. 12 is a structural schematic diagram of a protective ring of the ceiling fan of the present disclosure.
Figure 13:
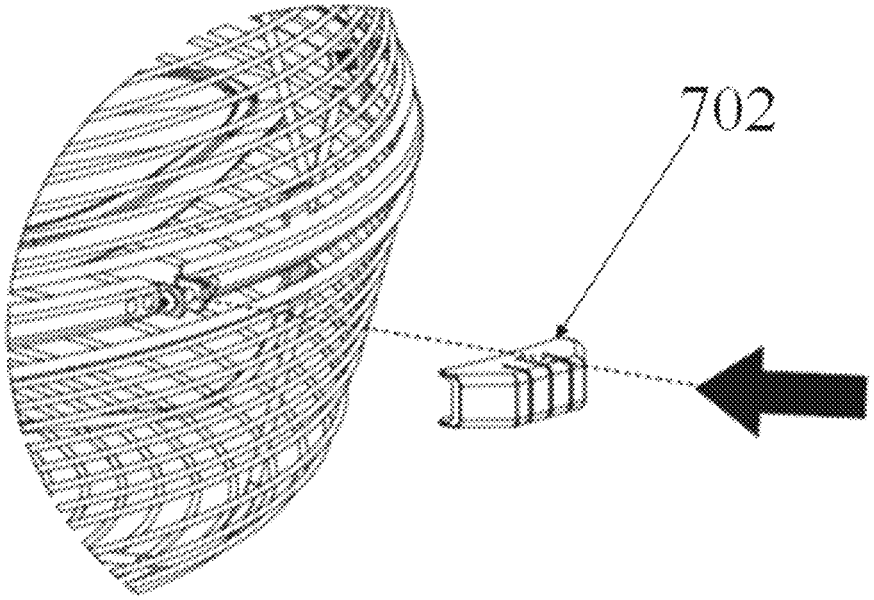
FIG. 13 is a partial structural schematic diagram of the ceiling fan of the present disclosure, showing installation of the protective ring.

As shown in FIGS. 1 and 12-13, the ceiling fan 10 further includes a protective assembly 700 which includes a protective ring 701 and a protective cover 702. The protective ring 701 surrounds a connection part between the lower grill 402 and the upper grill 401, and a pair of connecting pieces 7011 are provided at two free ends of the protective ring 701, and the pair of connecting pieces 7011 are detachably connected to each other by a screw. The protective cover 702 is covered on the two free ends of the protective ring 701 to cover the pair of connecting pieces 7011 and the screw, thereby further preventing the screw from loosening and from scratching the user. The protective cover 702 is sleeved on edges of the lower grill 402 and the upper grill 401 and clamps the screw to facilitate the installation and removal of the protective cover 702.

As shown in FIG. 1, the mounting fixture 100 includes a hook 101 and an elastic buckle 102, wherein the elastic buckle 102 is located at a hook mouth of the hook 101, and one end of the elastic buckle 102 is hinged to one end of the hook 101 close to the connecting rod 200, and a return spring is provided at a hinged joint. The other end of the elastic buckle 102 abuts against the free end of the hook 101. The return spring keeps the elastic buckle 102 against the free end of the hook 101. In this way, when the installation location of the ceiling fan 10 needs to be changed, the user may press the elastic buckle 102 to remove the ceiling fan 10, and then hang it to another desired location. When the user releases the elastic buckle 102, the elastic buckle 102 returns to the position against the free end of the hook 101. In this way, the hook 101 and the elastic buckle 102 are kept in a closed state, preventing the ceiling fan 10 from accidentally leaving its installation location.

Compared with the conventional art, the ceiling fan of the present disclosure has at least the following advantages:

First, by providing the mounting fixture and detachably connecting the switch assembly to the motor shaft connected to the stator and providing the switch assembly at the lower end of the lower grill, the user may freely adjust the installation location of the ceiling fan at any time according to needs to adjust the blowing range of the ceiling fan, and easily adjust a rotation speed of the ceiling fan, and the switch assembly is easy to disassemble.

Second, by setting the wiring of the connecting wires of the switch assembly in the hollow channel of the motor shaft connected to the stator, a wiring design of the switch assembly is simplified to prevent the wiring from being exposed to the outside.

Third, by setting connecting pieces between the upper grill and lower grill and connecting the two to each other through a horizontal screw, the screw is not easy to fall off.

Although the present invention has been disclosed in the form of embodiments and variations thereon, it will be understood that numerous additional modifications and variations could be made thereto without departing from the scope of the invention.

For the sake of clarity, it is to be understood that the use of 'a' or 'an' throughout this application does not exclude a plurality.

What is claimed:

1. A ceiling fan, comprising:

a mounting fixture configured to removably connect the ceiling fan to an installation location;

a connecting rod, one end of which is connected to the mounting fixture;

a motor assembly including a housing, a rotor and a stator located in the housing, and a motor shaft fixed to the stator, wherein a first end of the motor shaft is connected to the other end of the connecting rod, a second end of the motor shaft extends out of the housing, the motor shaft includes a hollow channel, and the rotor is sleeved on outside of the stator;

a protective grill including an upper grill and a lower grill that are removably connected to each other, forming an accommodation space therebetween, wherein the upper grill is connected to the housing;

a fan blade assembly, accommodated in the accommodation space and connected to the rotor; and a switch assembly configured to adjust a rotation speed of the rotor, wherein the switch assembly is connected to the motor shaft, the hollow channel is configured for wiring of connecting wires of the switch assembly, and the switch assembly is arranged at the center of the lower grill.

2. The ceiling fan of claim 1, wherein the switch assembly includes a switch seat, a mounting hole is provided at the center of a bottom of the switch seat, a thread is provided axially on an outer side of the second end of the motor shaft, the switch seat is sleeved on the second end of the motor shaft through the mounting hole and is connected to the motor shaft by a nut locked to the thread on the outer side of the second end of the motor shaft.

3. The ceiling fan of claim 2, wherein the switch assembly includes a switch, a switch plate and a knob, wherein the switch seat includes a mounting cavity, the switch is connected to the mounting cavity, the switch plate is mounted on the switch seat, and the knob is disposed above the switch plate and connected to the switch.

4. The ceiling fan of claim 3, wherein a recessed portion is provided at the center of the lower grill and is recessed toward the switch seat, a bottom surface of the recessed portion is a plane and is connected to the switch seat, the switch plate is mounted to the bottom surface of the recessed portion, the knob is arranged above the switch plate and is locked to the switch.

5. The ceiling fan of claim 1, wherein the upper grill is evenly provided with two or more upper connecting pieces around a circumferential edge of the upper grill, and the lower grill is evenly provided with more than two corresponding lower connecting pieces around a circumferential edge of the lower grill, each of the upper connecting pieces and each of the lower connecting pieces are both provided with a threaded hole, the upper connecting piece and the corresponding lower connecting piece are connected together by a screw, and when the ceiling fan is in use state, an axial direction of the screw is parallel to the horizontal plane.

6. The ceiling fan of claim 1, wherein the upper grill is provided with a motor assembly mounting hole and two or more fixings, the motor assembly mounting hole is arranged at the center of the upper grill, the two or more fixings are evenly distributed along a circumference of the motor assembly mounting hole and extend into the motor assembly mounting hole; a portion of each of the two or more fixings extending into the motor assembly mounting hole includes a stepped portion which abuts against the housing.

7. The ceiling fan of claim 1, wherein the ceiling fan further comprises a protective assembly which includes a protective ring and a protective cover; the protective ring surrounds a connection part between the lower grill and the upper grill, and a pair of connecting pieces are provided at two free ends of the protective ring, and the pair of connecting pieces are detachably connected to each other by a screw; the protective cover is covered on the two free ends of the protective ring to cover the pair of connecting pieces and the screw.

8. The ceiling fan of claim 7, wherein the protective cover is sleeved on edges of the lower grill and the upper grill and clamps the screw.

9. The ceiling fan of claim 1, wherein the fan blade assembly includes a fan blade seat and fan blades, the number of the fan blades is three or more and the fan blades are connected to the fan blade seat by screws.

10. The ceiling fan of claim 1, wherein the mounting fixture includes a hook and an elastic buckle, wherein the elastic buckle is located at a hook mouth of the hook, and one end of the elastic buckle is hinged to one end of the hook close to the connecting rod, and the other end of the elastic buckle abuts against the free end of the hook.

* * * * *